US006763617B1

(12) United States Patent
Stafford

(10) Patent No.: US 6,763,617 B1
(45) Date of Patent: Jul. 20, 2004

(54) INFLATABLE SNOWSHOE

(76) Inventor: James R. Stafford, 11820 Hilltop Dr., Anchorage, AK (US) 99515

( * ) Notice: Subject to any disclaimer, the term of this patent is extended or adjusted under 35 U.S.C. 154(b) by 0 days.

(21) Appl. No.: 10/352,696

(22) Filed: Jan. 27, 2003

(51) Int. Cl.[7] ..... A43B 5/04
(52) U.S. Cl. ..... 36/122
(58) Field of Search ..... 36/122–125, 29

(56) References Cited

U.S. PATENT DOCUMENTS

| | | | | | |
|---|---|---|---|---|---|
| 1,011,460 | A | * | 12/1911 | Maddocks | 36/29 |
| 2,128,134 | A | * | 8/1938 | Giusto | 36/7.5 |
| 2,430,466 | A | * | 11/1947 | Hedman | 36/7.5 |
| 2,756,517 | A | * | 7/1956 | Youtz | 36/7.8 |
| 3,423,852 | A | * | 1/1969 | Smith | 36/7.5 |
| 3,685,176 | A | * | 8/1972 | Rudy | 36/71 |
| 4,525,941 | A | * | 7/1985 | Ruth, Jr. | 36/116 |
| 4,611,411 | A | * | 9/1986 | Ringler et al. | 36/7.5 |
| 5,542,197 | A | * | 8/1996 | Vincent | 36/122 |
| 5,787,612 | A | * | 8/1998 | Mahoney et al. | 36/124 |
| 6,163,984 | A | * | 12/2000 | Faber et al. | 36/125 |

FOREIGN PATENT DOCUMENTS

| | | | |
|---|---|---|---|
| JP | 10024140 | * | 1/1998 |

* cited by examiner

*Primary Examiner*—Ted Kavanaugh
(74) *Attorney, Agent, or Firm*—Michael J. Tavella

(57) ABSTRACT

An inflatable snowshoe. In its deflated state, it can be flattened and rolled, which allows a pair of these snowshoes to be stored inside the cowling of a snowmobile. The snowshoe consists of a web flotation deck that has a tubular shaped air bladder frame. When inflated, the frame and deck take on the properties of a rigid conventional snowshoe. A puncture and abrasion resistant fabric covers the inner membrane that forms the bladder type, tubular air chamber. This air chamber makes up the peripheral frame of the snowshoe and is held to its teardrop shape by the multi-point restraint of the nylon web flotation deck. The nylon web flotation deck distributes the weight of the wearer. The binding attachment and the cross points of the nylon straps that form the deck are affixed with metal rivets, which also act as traction studs.

16 Claims, 5 Drawing Sheets

INFLATABLE SNOWSHOE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to snowshoes and particularly to inflatable snowshoes.

2. Description of the Prior Art

Conventional snowshoes have been constructed in many different ways since their conception nearly one hundred years ago. Typically, these designs utilize a rigid frame or solidly molded body. Inside the frame is a flotation deck. Flotation decks have been made of various materials from flexible mesh (catgut) to molded plates. Some molded plates are solid and others have holes or slots to allow loose snow and other particles to freely pass throug.

Regardless of the design, they all share the ability to distribute the weight of the wearer allowing him/her to walk on top of the surface of deep snow. However, they all have two major drawbacks: they are all bulky and heavy. This makes them hard to pack or store in a confined space.

These drawbacks come at a time when winter recreation is booming. Snowmobiles operate at high speeds and can climb mountains and traverse rougher terrain than ever before. This can put a rider many miles from safety in a matter of minutes on snow that without snowshoes a person would sink up past their waist should something go wrong and they find they must walk out. Many things can happen in extremely cold conditions when crossing unfamiliar terrain, at such high speeds, i.e. mechanical breakdowns, getting stuck in a ravine, running out of gas, or breaking the machine by crashing, and so on.

These problems are well known but still few snowmobile riders carry snowshoes because of their bulky characteristics. Practically, there is simply no place to secure the snowshoes to the machine so that to can be operated conveniently or safely.

There are many snowshoe designs that have been patented. Only a few of them are designed to collapse for convenient storage. For example U.S. Pat. Nos. 3,63,643 and 4,348,823 describe snowshoes that are made of sections. These sections can be assembled and pinned (or bolted) to make the snowshoe. When not needed, the snowshoes can be disassembled and stored. U.S. Pat. No. 5,309,652 teaches a kit snowshoe that has a center frame portion and replaceable tips and tails. In this way, one can make a snowshoe of different sizes as needed. It also allows the snowshoe to be broken down somewhat for storage. Finally, U.S. Pat. No. 5,459,950 teaches a snowshoe that has a segmented frame that is held together by shock cords, similar to modem tent poles. The segments can be separated for storage and reassembled for use without the problem of losing parts. While these patents have attempted to address the problems of the bulk of snowshoes, the solutions create as many problems. The segments of the breakdown models are still lengthy and require significant space to store. Moreover, some have parts that can be easily lost. Finally, they often require assembly that requires locating parts, attaching them together and perhaps bolting or pinning them. This may require tools as well as taking a substantial amount of time. In an emergency, under poor weather and light conditions, these snowshoes may be difficult or impossible to assembly properly.

BRIEF DESCRIPTION OF THE INVENTION

The instant invention overcomes these limitations. It is a snowshoe that is inflatable. In its deflated state, it can be flattened and rolled, which allows a pair of these snowshoes to be stored inside the cowling of a snowmobile. Moreover, a pair of them can easily be folded and placed in the tool caddy of the machine, the window bag, the rider's coat pocket or backpack.

This invention has a specific hybrid construction. The snowshoe consists of a web flotation deck that has a tubular shaped air bladder frame. When inflated, the frame and deck take on the properties of a rigid conventional snowshoe. However, due to it's unique design it is one of the most compact storable, easily carried, and lightest snowshoes available to date.

A puncture and abrasion resistant fabric covers the inner membrane that forms the bladder type, tubular air chamber. This air chamber makes up the peripheral frame of the snowshoe and is held to its teardrop shape by the multipoint restraint of the nylon web flotation deck.

The nylon web flotation deck distributes the weight of the wearer and is the surface to which an adjustable boot binding is attached. In the preferred embodiment, the boot binding straps are equipped with hook and loop type fasteners that provide for the adjustable feature of this binding. These bindings are fastened to the deck of the snowshoe along the centerline of the shoe and about ⅕ of the overall length back from the nose. The binding attachment and the cross points of the nylon straps that form the deck are affixed with metal rivets. These metal rivets are applied to the structure from the underneath side of the snowshoe.

The installation of these rivets in this manner allows them to be used as traction studs that dig into ice and other slippery surfaces when the wearer's weight is applied.

A standard automotive/bicycle type tire valve is incorporated into the nose of the air bladder and used as the point of inflation. The use of sum a valve allows for inflation by means of any standard tire inflation devise. In one embodiment, a built in $CO_2$ device, such as commonly found on many life jackets used in boating, is installed on the front of the snowshoe for automatic inflation. The snowshoes can also be sold with a plug and patch kit in case it becomes necessary to patch a hole in the air chamber.

The boot bindings are attached to the web deck. They are adjustable to fit different types and sizes of boots. These bindings are made of the same nylon strap material that forms the flotation deck. The binding straps have hook and loop type fasteners for ease of adjustment. As discussed above, the toe portion of these bindings is attached to the web deck approximately ⅕ of the snowshoe's overall length back from the nose and on the centerline of the shoe. As is true with a conventional snowshoe, this placement of the binding causes the nose of the snowshoe to pivot upward and the tail to drop as the wearer picks up his/her foot to walk. This allows the wearer to move in a forward direction without the nose of the snowshoe digging in and causing a tripping effect. This action also allows the wearer to more easily step over obstacles and traverse uneven terrain.

Prior to inflation these snowshoes can be folded into a compact state or laid out flat if so required for ease of storage and carry. There are two means of inflating these snowshoes. One is the use of a standard type automotive/bicycle tire pump many of which are now made so compact they will fit into a shirt pocket. The other means of inflation is the use of pressurized $CO_2$ cartridges. The standard version of this inflatable snowshoe can be inflated with the $CO_2$ by using a hand held device. In a second embodiment a built in $CO_2$ dispenser is attached.

It is an object of this invention to produce an inflatable snowshoe that can be easily stored in a deflated state.

It is another object of this invention to produce an inflatable snowshoe that in its inflated state demonstrates adequate rigidity around its peripheral dimension to provide a framework for a nylon web deck to supply weight-distributing flotation to the wearer on snow.

It is yet another object of this invention to produce an inflatable snowshoe in which the nylon straps that form the webbed deck of the snowshoe maintains the tubular air chamber frame in the conventional teardrop shape found in many conventionally built snowshoes.

It is yet another object of this invention to produce an inflatable snowshoe in which the nylon straps that make up the web deck of this snowshoe are wide enough to produce ample flotation, even with the large spaces between the straps that allow loose snow and ice to freely pass through the webbing so as not to build up under the wearers boot.

It is yet another object of this invention to produce an inflatable snowshoe in which metal rivets holding the web straps and bindings together act as traction studs on ice and other slippery surfaces as weight is applied by the stepping down action of the wearer.

It is yet another object of this invention to produce an inflatable snowshoe in which a fabric covered membrane forms the tubular air chamber or rails of the snowshoes frame, which is held in place by the nylon web flotation deck and in turn supports the flotation deck when inflated and is extremely light weight. It gains no additional weight when inflated.

It is yet another object o this invention to produce an inflatable snowshoe in which a standard automotive/bicycle tire type inflation valve is used to inflate this snowshoe using any pump, $CO_2$ dispensing devise, or pressurized can of air.

It is yet another object of this invention to produce an inflatable snowshoe that can be stored on a conventional snowmobile without interfering with the operation of the snowmobile.

DETAILED DESCRIPTION OF THE INVENTION

Figure 1:
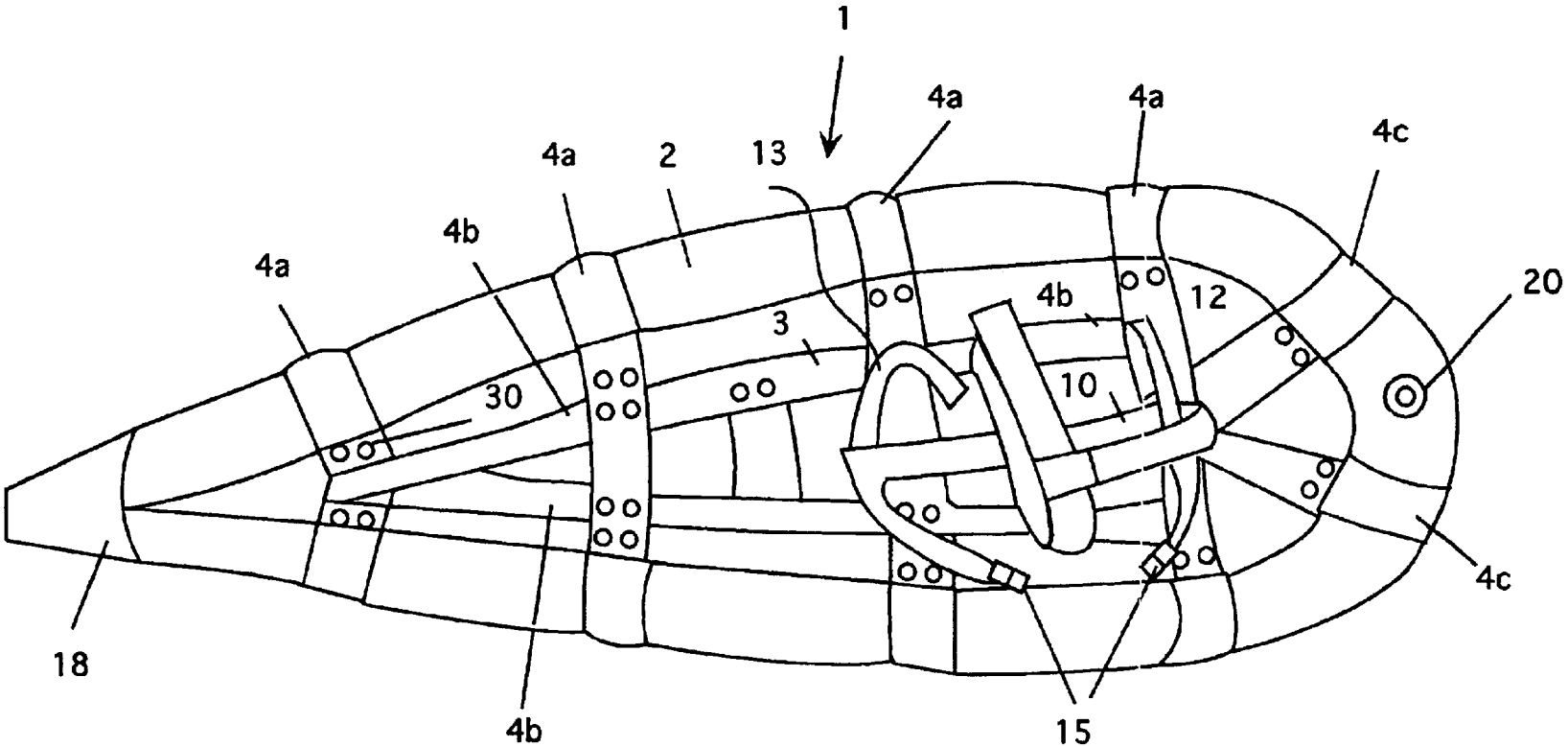
FIG. 1 is a top view of the invention as fully inflated.

Referring now to FIG. 1, the invention 1 is a snowshoe that has an air chamber tube assembly 2 that forms the frame of the snowshoe and a web flotation deck 3 made up of a number of nylon straps. A boot binding assembly 4 is attached to the web flotation deck 3 as discussed below.

Figure 3:
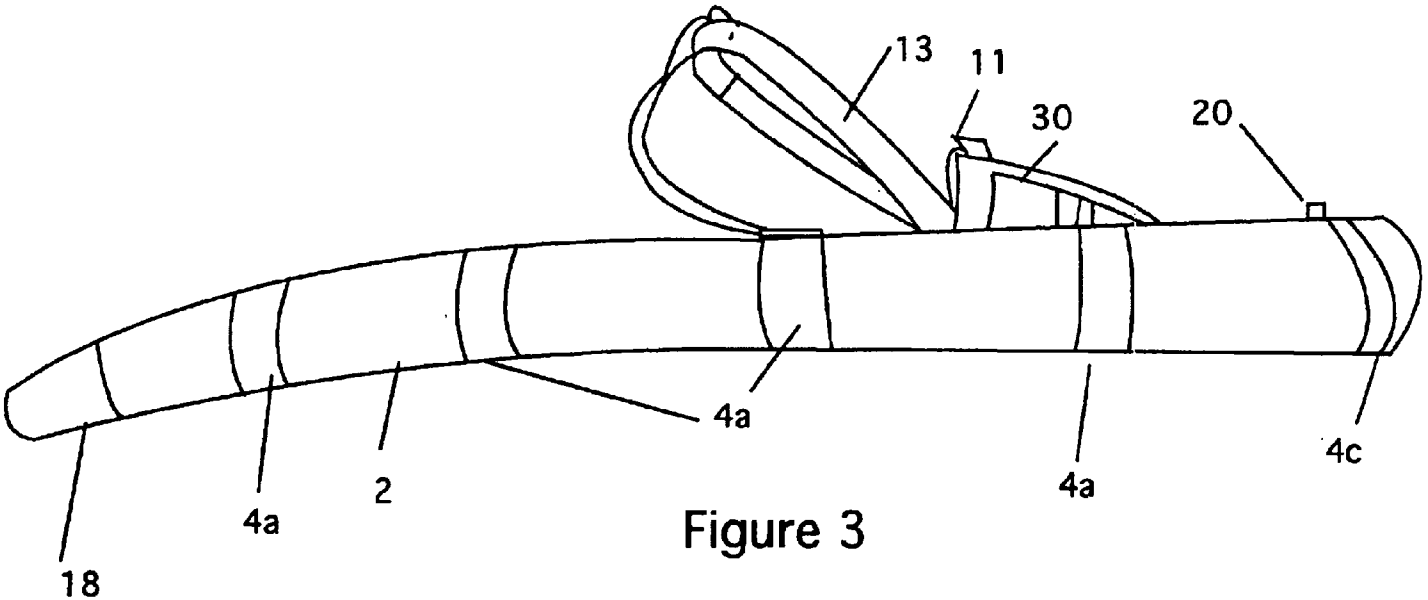
FIG. 3 is a right side view of the invention as fully inflated.
Figure 4:
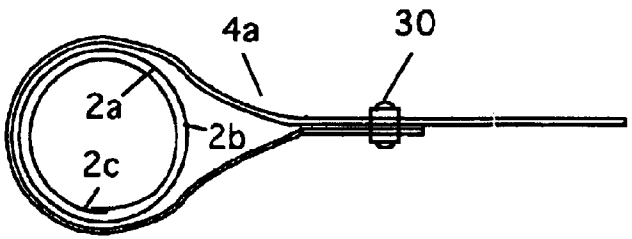
FIG. 4 is a cross-sectional view of the invention taken along the lines 4—4 of FIG. 1.

The instant snowshoe 1 demonstrates rigidity only when inflated with air. The snowshoe rails are constructed of the air chamber tube assembly 2, which has an inner membrane 2*a* that is formed in the shape of a tubular air bladder connected and capped at the two ends. This air bladder 2*a* is shaped as a long cylinder. By placing the two ends of the cylinder together side by side and then holding them with an end cap 18, the cylinder creates the appearance of a teardrop shape most commonly found in a standard snowshoe. (See, e.g., FIGS. 1 and 3). As shown, the air chamber tube assembly 2 is rounded in the nose and tapers down to a pointed tail. As shown in FIG. 4, the inner membrane 2*a* that forms the rails is covered with a protective fabric 2*b* that aids in the prevention of punctures and abrasions as well as maintaining a uniform diameter around the entire circumference of the snowshoe.

Figure 2:
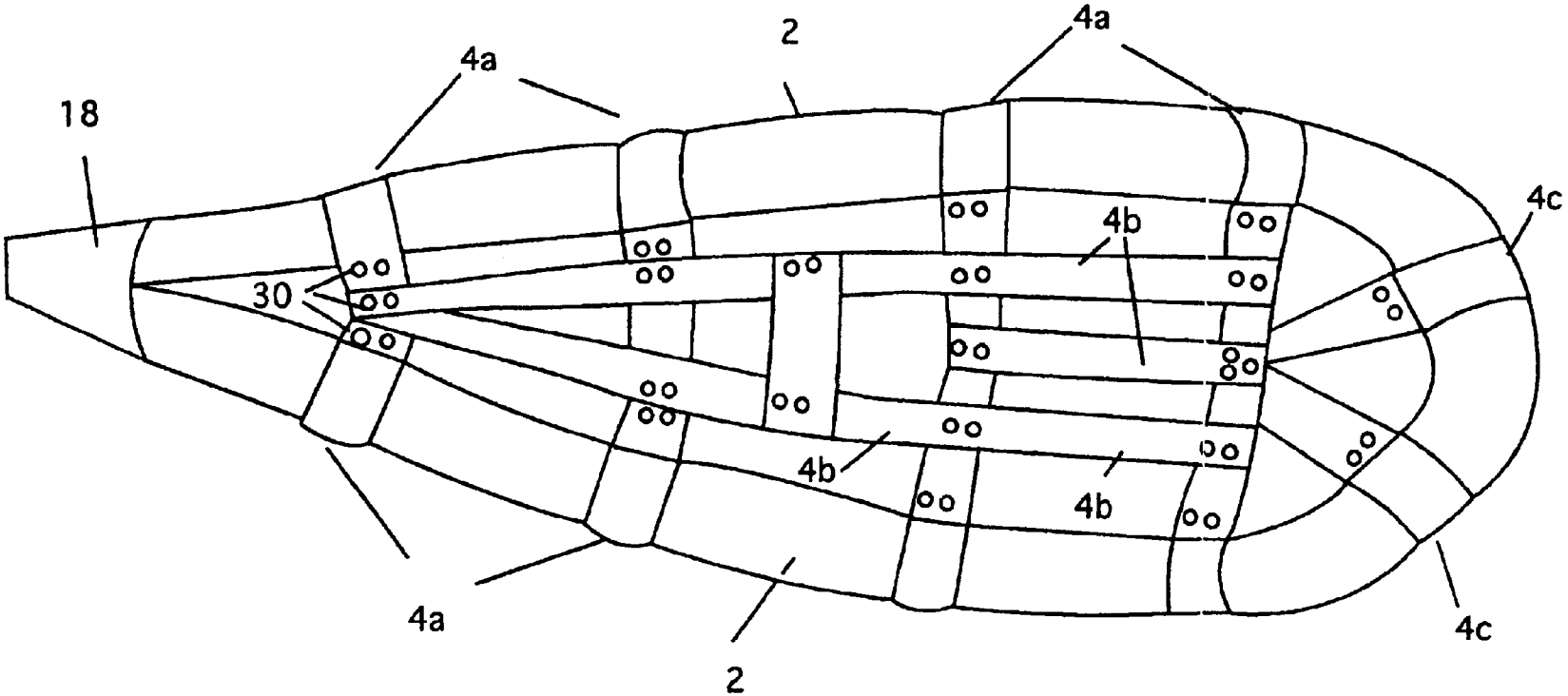
FIG. 2 is a bottom view of the invention as fully inflated.

In the preferred embodiment, the nose of this snowshoe is in the shape of a wide arc leading to the sides of the frame, which is wider tan the wearer's foot. The arc extends approximately ⅔ of the overall length back from the nose of the snowshoe before tapering down to the point of the tail. This is shown in FIGS. 1, 2 and 3. Note that this shape can be modified to use different dimensions or sizes as needed.

The deck 3 of this snowshoe is made of a series of nylon straps laid out in a crossing pattern that forms a web. There are horizontal straps 4*a* and vertical straps 4*b*. Two angled straps 4*c* are attached to the head of the snowshoe as shown. This webbed deck 3 makes up the flotation surface of the snowshoe that supports and distributes the weight of the wearer on the surface of various types of snow conditions. It also holds the outside peripheral tubular air chamber frame 2 in the snowshoe shape, as discussed above.

Figure 5:
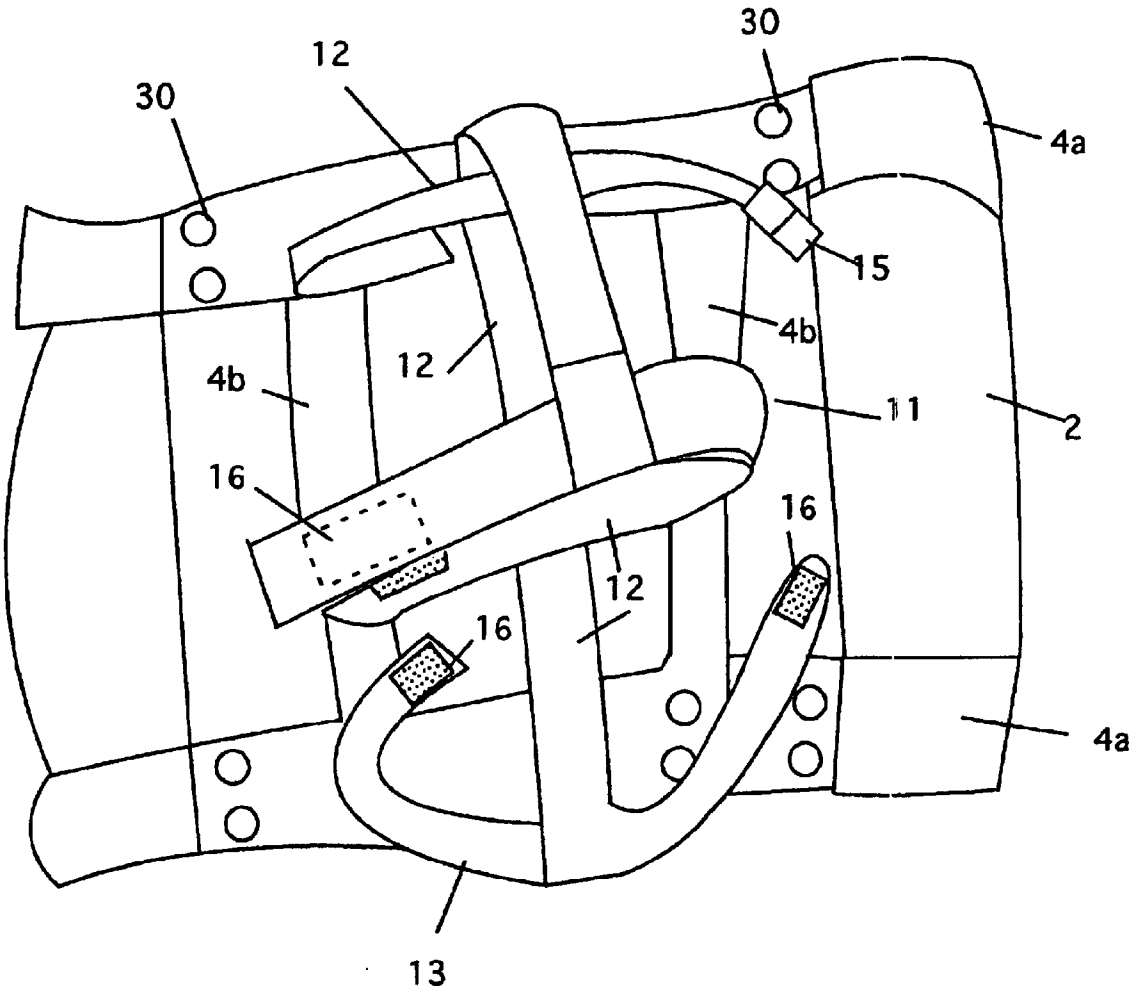
FIG. 5 is an enlarged top view of the binding assembly.

Referring now to FIGS. 1, 3 and 5, the binding assembly has a main strap 10 that runs in a curve from the top of the center strap 11. It then extends forward and down, forming a curved area in which the toe of a boot (not shown) fits. The main strap 10 then curves back, running under the foot to the heel area. This main binding strap has the front toe strap 12 and the center strap 11. The main strap keeps these straps centered. The other end of the main strap 10*a* attaches to and centers an ankle strap 13. Strap. The straps 11, 12 and 13 can be secured by buckles 15, or, in the preferred embodiment, by short lengths of hook and loop fasteners 16 attached to them. The use of the hook and loop fasteners is preferred because it makes adjusting the straps easy and fast. Note that the figures show both straps and hook and loop fasteners. This is done for convenience. The straps can use all hook and loop fasteners, all buckles, or a combination of both. Note that the binding assembly discussed above is defined as a means for attaching a boot. These combinations are well within the skill of a person of ordinary skill in the art.

Figure 6:
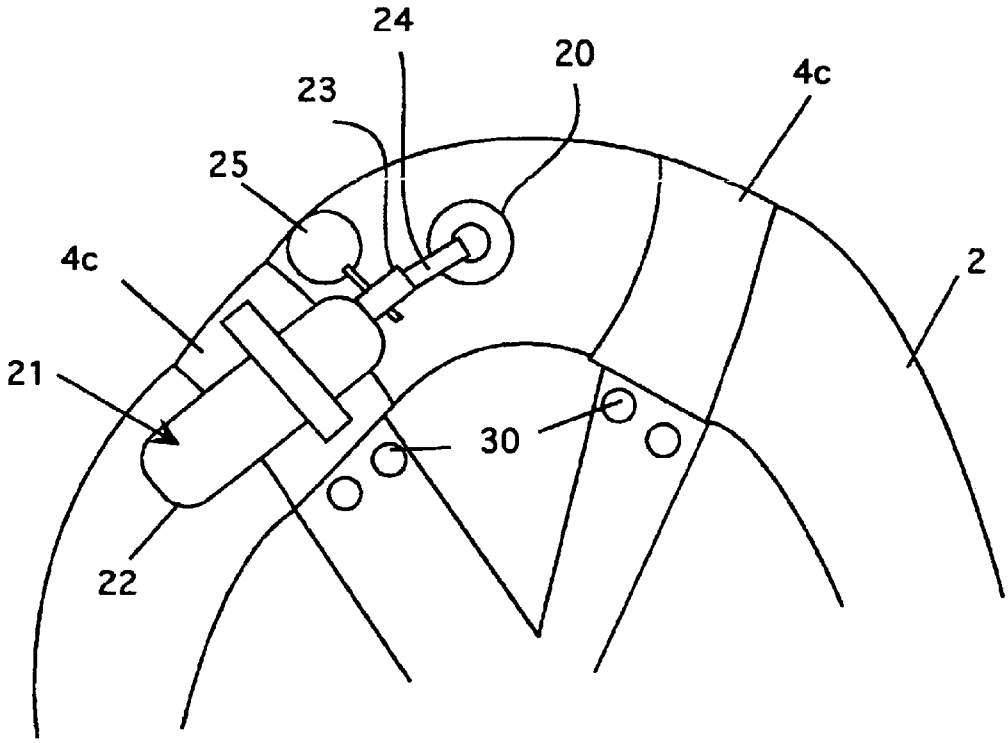
FIG. 6 is a detail view of an alternative inflation system.

Referring now to FIGS. 1 and 3, an automotive/bicycle type tire inflation valve 20 is placed at the front end of the snowshoe as shown. The valve is construed as a means for inflating said tubular air chamber. FIG. 6 is a detail view of the front of the snowshoe showing an optional $CO_2$ inflation device 21, which can be construed as part of the means for inflating said tubular air chamber. In this embodiment, the $CO_2$ inflation device 21 is positioned near the inflation valve 20. The $CO_2$ inflation device 21 is operated in a manner common to the art to inflate the snowshoe for use. For example, one such device has a $CO_2$ cartridge 22. The cartridge has a valve 23 that attaches to a connector 24, which connects to the valve 20. Note that the connector 24 can be construed as a means for attaching the $CO_2$ cartridge to the air valve. A pin 25 blocks the valve 23 until the user wants to inflate the snowshoe.

FIG. 2 shows the underside of the snowshoe 1 indicating the locations of the metal rivets 30 that affix the nylon straps of the web assembly 3 as well as the attachment of the boot binding assembly. Note that the rivets 30 are installed so that their ends protrude slightly from the bottom of the snowshoe. These protruding ends act as studs that help grip the ice and snow when the snowshoe is worn. The weight of the user helps to push the studs into the snow for better traction.

FIG. 4 is a cross-sectional view of the snowshoe 1. The snowshoe frame 2 has an inner membrane 2*a* that acts an air bladder. This figure shows that the seam 2*c* of the membrane is located at the bottom of the tube adding to the rigidity of the air tube 2 when inflated. As discussed above, surrounding the tube is a puncture and abrasion resistant fabric outer protective cover 2*c*, which acts to protect the tube from damage.

FIG. 4 also shows one of the multi-point attachments of the nylon straps 4*a* of the web deck 3 to the air chamber assembly 2. Note that this strap 4*a* is not affixed to the air chamber 2. The nylon strap 4*a* simply encompasses the air chamber assembly 2 and is attached back to itself by metal rivets 30, as discussed above. This construction allows for a tight fit of the web flotation deck 3 to the air chamber assembly 2 when the air chamber assembly 2 is inflated, but leaves slack space when the snowshoe is deflated. This allows for ease in folding the snowshoe into its compact state for storage.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An inflatable snowshoe comprising:

a) a tubular air chamber forming a loop with an open center, having two sealed ends;

b) a web frame, attached to said tubular air chamber; and c) a means for inflating said tubular air chamber.

2. The inflatable snowshoe of claim 1 further comprising a means for attaching a boot to said snowshoe, attached to said web frame.

3. The inflatable snowshoe of claim 1 further comprising an end cap, fixedly attached to the two sealed ends of said tubular air chamber.

4. The inflatable snowshoe of claim 1 wherein said tubular air chamber is bent such that said tubular air chamber forms a teardrop shape.

5. The inflatable snowshoe of claim 1 wherein said tubular air chamber is covered by a protective cover.

6. The inflatable snowshoe of claim 1 wherein the means for inflating said tubular chamber comprises an air valve.

7. The inflatable snowshoe of claim 6 wherein the means for inflating said tubular chamber farther comprise:

a) a CO2 cartridge; and b) a means for attaching said $CO_2$ cartridge to said air valve.

8. The inflatable snowshoe of claim 1 wherein the web frame is secured with a plurality of metal rivets.

9. The inflatable snowshoe of claim 8 wherein the plurality of metal rivets extend below said web frame to act as traction studs.

10. An inflatable snowshoe comprising:

a) a tubular air chamber, having two sealed ends, said tubular air chamber being formed into a teardrop shape having an open center;

b) a web frame, attached to said tubular air chamber, such that said web frame fits about said tubular air chamber to form a web platform within said open center of said tubular frame;

c) an end cap, fixedly attached to the two sealed ends of said tubular air chamber; and d) a means for inflating said tubular air chamber.

11. The inflatable snowshoe of claim 10 further comprising a means for attaching a boot to said snowshoe, attached to said web frame.

12. The inflatable snowshoe of claim 10 wherein said tubular air chamber is covered by a protective cover.

13. The inflatable snowshoe of claim 10 wherein the means for inflating said tubular chamber comprises an air valve.

14. The inflatable snowshoe of claim 13 wherein the means for inflating said tubular chamber further comprise:

a) a CO2 cartridge; and b) a means for attaching said $CO_2$ cartridge to said air valve.

15. The inflatable snowshoe of claim 10 wherein the web frame is secured with a plurality of metal rivets.

16. The inflatable snowshoe of claim 15 wherein the plurality of metal rivets extend below said web frame to act as traction studs.

* * * * *